US007808445B2

(12) United States Patent
von Arbin

(10) Patent No.: US 7,808,445 B2
(45) Date of Patent: Oct. 5, 2010

(54) ANTENNA DEVICE AND PORTABLE RADIO COMMUNICATION DEVICE COMPRISING SUCH AN ANTENNA DEVICE

(75) Inventor: Axel von Arbin, Täby (SE)

(73) Assignee: Laird Technologies AB, Kista (SE)

( * ) Notice: Subject to any disclaimer, the term of this patent is extended or adjusted under 35 U.S.C. 154(b) by 0 days.

(21) Appl. No.: 11/573,923

(22) PCT Filed: Sep. 2, 2005

(86) PCT No.: PCT/SE2005/001271

§ 371 (c)(1),
(2), (4) Date: Feb. 19, 2007

(87) PCT Pub. No.: WO2006/031171

PCT Pub. Date: Mar. 23, 2006

(65) Prior Publication Data

US 2008/0224942 A1 Sep. 18, 2008

(30) Foreign Application Priority Data

Sep. 13, 2004 (SE) ..... 0402181

(51) Int. Cl.
*H01Q 3/24* (2006.01)

(52) U.S. Cl. ..... 343/876; 343/700 MS; 343/702

(58) Field of Classification Search ..... 343/876, 343/829, 845, 846, 848, 722, 746, 700 MS, 343/702
See application file for complete search history.

(56) References Cited

U.S. PATENT DOCUMENTS 4,780,724 A 10/1988 Sharma et al.
5,585,810 A * 12/1996 Tsuru et al. ..... 343/745
6,034,640 A 3/2000 Oida et al.
7,099,690 B2 * 8/2006 Milosavljevic ..... 455/552.1

FOREIGN PATENT DOCUMENTS

| | | | |
|---|---|---|---|
| EP | 1 296 410 | A1 | 8/2002 |
| EP | 1361623 | A1 * | 11/2003 |
| JP | 10-190347 | | 7/1998 |
| JP | 11136025 | | 5/1999 |
| JP | 2000-236209 | | 8/2000 |
| SE | 0301200-2 | | 4/2003 |

(Continued)

OTHER PUBLICATIONS

First Chinese Office Action from Chinese patent application No. 200580030502.8, dated Nov. 27, 2009 (8 pages).

(Continued)

*Primary Examiner*—Tan Ho
(74) *Attorney, Agent, or Firm*—Harness, Dickey & Pierce, P.L.C.

(57) ABSTRACT

The present invention relates to a portable radio communication device operable in at least a first and a second frequency band, the antenna device comprises a first electrically conductive radiating element comprises a first feeding portion connectable to a feed device (RF) of the radio communication device for feeding and receiving radio frequency signals, a ground plane provided at a distance from the first radiating element, a DC-blocking device connecting the first electrically conductive radiating element and the ground plane at a first position, and a controllable switch connecting the first electrically conductive radiating element and the ground plane at a second position.

20 Claims, 1 Drawing Sheet

FOREIGN PATENT DOCUMENTS

| | | | | |
|---|---|---|---|---|
| SE | 0302979-0 | | | 11/2003 |
| SE | 0400203-6 | | | 2/2004 |
| WO | WO 01/20718 | A1 | | 3/2001 |
| WO | WO 0120718 | A1 | * | 3/2001 |
| WO | WO 2004/047223 | A1 | | 6/2004 |
| WO | WO 2004/095633 | A1 | | 11/2004 |

OTHER PUBLICATIONS

International Search Report from International application No. PCT/SE2005/001271, dated Dec. 15, 2005 (4 pages).

Supplementary European search report from European application No. 05777720.3, dated Aug. 11, 2008 (7 pages).

Qiang Chen, Makoto Kurahashi and Kunio Sawaya "Dual-Mode Patch Antenna with PIN Diode Switch", 2003.

Office Action from the Swedish Patent Office dated Feb. 23, 2005, for Swedish Patent Application No. 0402181-2 (4 pages).

Written Opinion from the International Searching Authority dated Dec. 21, 2005, for International Patent Application No. PCT/SE2005/001271 (5 pages).

* cited by examiner

ANTENNA DEVICE AND PORTABLE RADIO COMMUNICATION DEVICE COMPRISING SUCH AN ANTENNA DEVICE

FIELD OF INVENTION

The present invention relates generally to antenna devices and more particularly to a controllable internal multi-band antenna device for use in portable radio communication devices, such as in mobile phones. The invention also relates to a portable radio communication device comprising such an antenna device.

BACKGROUND

Internal antennas have been used for some time in portable radio communication devices. There are a number of advantages connected with using internal antennas, of which can be mentioned that they are small and light, making them suitable for applications wherein size and weight are of importance, such as in mobile phones. A type of internal antenna that is often used in portable radio communication devices is the so-called Planar Inverted F Antenna (PIFA).

However, the application of internal antennas in a mobile phone puts some constraints on the configuration of the antenna, such as the dimensions of the radiating element or elements, the exact location of feeding and grounding portions etc. These constraints may make it difficult to find a configuration of the antenna that provides a wide operating band. This is particularly important for antennas intended for multi-band operation, wherein the antenna is adapted to operate in two or more spaced apart frequency bands. In a typical dual band phone, the lower frequency band is centered on 900 MHz, the so-called GSM 900 band, whereas the upper frequency band is centered around 1800 or 1900 MHz, the DCS and PCS band, respectively. If the upper frequency band of the antenna device is made wide enough, covering both the 1800 and 1900 MHz bands, a phone operating in three different standard bands is obtained. In the near future, antenna devices operating four or even more different frequency bands are envisaged.

The number of frequency bands in passive antennas is limited by the size of the antenna. To be able to further increase the number of frequency bands and/or decrease the antenna size, active frequency control can be used. An example of active frequency control is disclosed in the Patent Abstracts of Japan 10190347, which discloses a patch antenna device capable of coping with plural frequencies. To this end there are provided a basic patch part and an additional patch part which are interconnected by means of PIN diodes arranged to selectively interconnect and disconnect the patch parts. Although this provides for a frequency control, the antenna device still has a large size and is not well adapted for switching between two or more relatively spaced apart frequency bands, such as between the GSM and DAMSP and/or DCS and PCS bands.

Instead, this example of prior art devices is typical in that switching in and out of additional patches has been used for tuning instead of creating additional frequency band at a distance from a first frequency band.

The Patents Abstracts of Japan publication number JP2000-236209 discloses a monopole antenna comprising a linear conductor or on a dielectric substrate, see FIG. 1. Radiation parts of the antenna are composed of at least two metal pieces connected through diode switch circuits. The radiation elements have feed points connected to one end of a filter circuit, which cuts of a high-frequency signal. A signal $V_{switch}$ is used to control the diode switch. The disclosed configuration is limited to monopole or dipole antennas. Also, the object of the antenna according to the above mentioned Japanese document is not to provide an antenna with a small size.

A problem in prior art antenna devices is thus to provide a multi-band antenna of the PIFA type with a small size and volume and broad frequency bands which retains good performance.

SUMMARY OF THE INVENTION

It is a main object of the present invention to provide such apparatus and method that at least alleviate the above problems.

An object of the present invention is to provide an antenna device of the kind initially mentioned wherein the frequency characteristics provides for at least two comparatively wide frequency bands while the overall size of the antenna device is small.

Another object is to provide an antenna device having better multi-band performance than prior art devices.

The invention is based on the realization that several frequency bands can be provided in a physically very small antenna by arranging the antenna so that the effective frequency band for the radiating elements can be controlled by controlling a switch. That is, the radiating elements may be tuned to a first frequency band, or a first set of frequency bands, in a first mode and a second frequency band, or set of frequency bands, in a second mode by operating the switch.

Patent applications SE0301200-2, SE0302979-0, SE0400203-6 filed in Sweden by the same applicant as the present application concerns similar matters as the present invention and are hereby incorporated by this reference. A concurrent application filed Sweden on the same date as the present application by the same applicant also concerns the same area and is hereby also incorporated by this reference.

It has been suggested that the radiating elements should be divided in two parts and connected with a switch to thereby achieve the above purpose. On such switch element may be a diode. Since, however, diodes are not ideal components it has been discovered that they may cause sharp harmonics which may not be tolerated in some standards.

Furthermore it would be beneficial if the switch need not to be operated as frequently. If the radio communication device need to listen to different frequencies, which are only attainable by operating the switch, only based on for instance geographic position of the operator of the radio communication device this would simplify the operation of the radio communication device.

It is a main object of the present invention to provide such apparatus and method that at least alleviate the above problems.

These objects among others are, according to a first aspect of the present invention, attained by an antenna device for a portable radio communication device operable in at least a first and a second frequency band, the antenna device comprises a first electrically conductive radiating element comprises a first feeding portion connectable to a feed device (RF) of the radio communication device for feeding and receiving radio frequency signals, a ground plane provided at a distance from the first radiating element, a DC-blocking device connecting the first electrically conductive radiating element and the ground plane at a first position, and a controllable switch connecting the first electrically conductive radiating element and the ground plane at a second position.

The above objects among others are, according to a second aspect of the present invention, attained by a method for achieving multi-band characteristics for a antenna having at least one radiating element provided above a ground plane, and wherein the radiating element is connected to the first ground plane portion through a DC-blocking device at a first position, comprising the steps of:—feeding a radio frequency signal to the radiating element, and—operating a switch provided between the radiating element and the ground plane, wherein the switch is open to radio frequency signals in a first mode and closed to radio frequency signals in a second mode, to alter the effective operating frequency band of the antenna.

The above objects among others are, according to a third aspect of the present invention, attained by a portable radio communication device, comprising such an antenna device.

By the arrangement above it is possible to reduce harmonics introduced by the diode. Further more it is possible to achieve an antenna that has resonance frequencies corresponding to the frequencies used in US, that is 850 MHz and 1900 MHz corresponding to DAMPS and PCS, in a first mode, and resonance frequencies corresponding to the frequencies used in Europe, that is 900 MHz and 1800 MHz corresponding to GSM and DCS, in a second mode.

According to one variant of the present invention the switch comprises a PIN diode and the DC-blocking device comprises a capacitor.

According to one variant of the present invention the switch can take two states and is controlled by means of a control voltage input ($V_{Switch}$).

According to one variant of the present invention the radiating element comprises a second feeding portion for feeding a DC-voltage to the radiating element to thereby control the switch.

According to one variant of the present invention wherein the radiating element is substantially planar.

According to one variant of the present invention a first filter is provided between the first feeding portion and the radiating element and the first filter is a high pass filter blocking substantially all DC-signals supplied for controlling the switch.

According to one variant of the present invention a second filter is provided between the second feeding portion and the radiating element and the second filter is a low pass filter blocking substantially all radio frequency signals received or transmitted by the antenna device.

According to one variant of the present invention the antenna device comprises a second radiating element.

According to one variant of the present invention the first radiating element has a configuration that provides for more than one resonance frequency.

According to one variant of the present invention the second radiating element has a configuration that provides for more than one resonance frequency.

According to one variant of the present invention the switch is set into the first mode by providing a first DC-voltage on the radiating element and into the second mode by providing a second DC-voltage on the radiating element.

Further characteristics of the invention and advantages thereof will be evident from the following detailed description of embodiments of the invention.

BRIEF DESCRIPTION OF THE DRAWINGS

The present invention will become more fully understood from the detailed description of embodiments of the present invention given herein below and the accompanying FIGS. 1 and 2, which are given by way of illustration only, and thus are not limitative of the present invention.

PREFERRED EMBODIMENTS

In the following description, for purposes of explanation and not limitation, specific details are set forth, such as particular techniques and applications in order to provide a thorough understanding of the present invention. However, it will be apparent to one skilled in the art that the present invention may be practiced in other embodiments that depart from these specific details. In other instances, detailed descriptions of well-known methods and apparatuses are omitted so as not to obscure the description of the present invention with unnecessary details.

Figure 1:
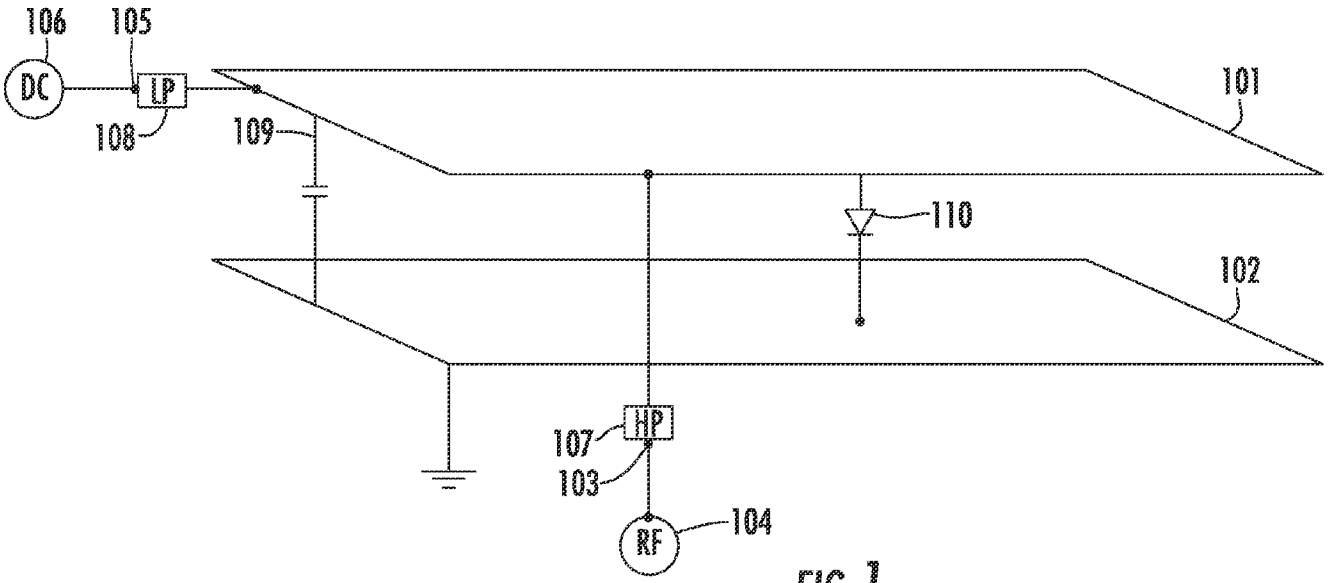
FIG. 1 is a schematic perspective view of an antenna device according to one variant of the present invention.

FIG. 1 is a schematic perspective view of an antenna device according to one variant of the present invention having a radiating element 101 provided above a ground plane 102. Even though the radiating element 101 is shown as a substantial rectangular sheet it may take other forms to be tuned to the desired frequency band as is much discussed in the prior art. Such forms include U-shape, E-shape, W-shape, a meandering shape or any other suitable shape and may comprise active or passive components. The radiating element 101 may even consist of several parts connected by inductances, capacitances or active components such as diodes. It is however in general planar but may comprise parts being folded to protrude towards the ground plane.

The radiating element 101 comprises a first feeding portion 103 connectable to a radio communication device (not shown) for feeding a radio frequency signal 104 to the radiating element 101. The radio frequency signal is passed through a high-pass filter 107 which prevents any DC-components from reaching the radio communication device through the first feeding portion 103.

The radiating element 101 further comprises a second feeding portion 105 connectable to the radio communication device for feeding a DC-voltage 106 $V_{switch}$ to the radiating element 101. The DC-voltage is passed through a low-pass filter 108 which prevents any RF-components from reaching the radio communication device through the second feeding portion 105.

The radiating element 101 is connected to the ground plane at a first position through a DC-blocking device 109. The DC-blocking device prevents DC-signals from going from the radiating element to the ground plane through the DC-blocking device, but allows RF-signals to go from the radiating element to the ground plane through the DC-blocking device. Thus, the DC-blocking device operates as the grounding pin connecting the radiating element and the ground plane in a PIFA-antenna for RF-signals but acts as an open circuit to DC-signals.

The radiating element is further connected to the ground plane at a second position through a switch, in this variant of the invention implemented using a diode 110.

When no DC-voltage is applied to the radiating element 101 through the second feeding portion 105 the diode 110 is an open circuit and the antenna device will have some resonance frequency, or frequencies, depending on the particular design of the radiating element. It is common knowledge to design such an antenna to have two resonance frequencies, such as for the 850 and 1900 MHz bands.

Figure 2:
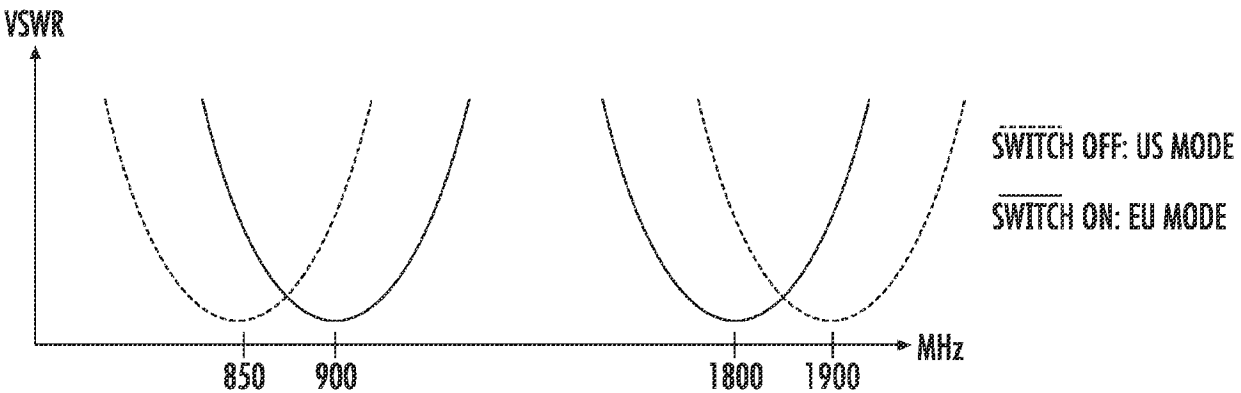
FIG. 2 is a frequency diagram showing the operating modes of the antenna device in FIG. 1.

The switch is operated by applying a DC-voltage $V_{switch}$, preferably in the range 1 to 5 volt, to the radiating element 101 through the feeding portion 105. Since the DC-blocking device 109 will not transfer the DC-signal, the DC-signal will go through the diode 110 to the ground plane. At this time the diode will open and be a short-circuit also for RF-signals, in other words it will provide a second grounding pin between the radiating element 101 and the ground plane 102, and the resonance frequency for the antenna device will change. If the antenna has been designed having two resonance frequencies, the two resonance frequencies will be pushed together. That is, the antenna can be designed for 850 and 1900 MHz, which are the frequencies used in US, when the switch is off, and for 900 and 1800 MHz, which are the frequencies used in Europe, when the switch is on as is shown in FIG. 2. This is beneficial since the switch need not to be operated as frequently.

It will be obvious that the invention may be varied in a plurality of ways. Such variations are not to be regarded as a departure from the scope of the invention. All such modifications as would be obvious to one skilled in the art are intended to be included within the scope of the appended claims.

The invention claimed is:

1. An antenna device for a portable radio communication device operable in at least a first and a second frequency band, the antenna device comprising:

an electrically conductive radiating element simultaneously operable in at least said first and second frequency band, said electrically conductive radiating element including a first feeding portion connectable to a feed device of said radio communication device for feeding and receiving radio frequency signals;

a ground plane a distance from said radiating element;

a DC-blocking device coupled between a first position on said radiating element and said ground plane;

a first filter coupled between said first feeding portion and said radiating element; and a controllable switch coupled between a second position on said radiating element and said ground plane, such that there is a substantial radiating end of the radiating element on a side of the second position which is opposite the first position, allowing the antenna device to act as a planar inverted F antenna regardless of the state of said switch.

2. The antenna device according to claim 1, wherein said switch comprises a PIN diode.

3. The antenna device according to claim 1, wherein said DC-blocking device comprises a capacitor.

4. The antenna device according to claim 1, wherein said switch can take two states and is controlled by means of a control voltage input.

5. The antenna device according to claim 1, wherein said radiating element comprises a second feeding portion for feeding a DC-voltage to said radiating element to thereby control said switch.

6. The antenna device according to claim 5, wherein a second filter is coupled between said second feeding portion and said radiating element.

7. The antenna device according to claim 6, wherein said second filter is a low pass filter blocking substantially all radio frequency signals received or transmitted by said antenna device.

8. The antenna device according to claim 1, wherein said radiating element is a substantially planar rectangular sheet, and wherein the first and second positions are adjacent an end portion and middle portion, respectively, of the substantially planar rectangular sheet.

9. The antenna device according to claim 1, wherein said first filter is a high pass filter blocking substantially all DC-signals for controlling said switch.

10. The antenna device according to claim 1, wherein said first radiating element has a configuration that provides for more than one resonant frequency.

11. The antenna device according to claim 1, wherein the antenna is coupled to a portable radio communication device.

12. The antenna device of claim 1, wherein the antenna device is simultaneously operable in the first frequency band and the second frequency band when the controllable switch is open and the antenna device is simultaneously operable in a third frequency band and a fourth frequency band when the controllable switch is closed.

13. The antenna device of claim 12, wherein a frequency spacing between the third frequency band and the fourth frequency band is less than a frequency spacing between the first frequency band and the second frequency band.

14. The antenna device of claim 1, wherein the radiating element has a first end and a second end, and the second position on said radiating element is spaced away from the first end and the second end of said radiating element.

15. The antenna device of claim 1, wherein the DC-blocking device is a first grounding pin for the radiating element and the controllable switch is operable as a second grounding pin for the radiating element when the controllable switch is closed.

16. A portable radio communication device comprising the antenna device of claim 1.

17. A method for achieving multi-band characteristics for an antenna having at least one radiating element above a ground plane, a DC-blocking device is coupled between a first position on said radiating element and the ground plane, and a first filter coupled between a first feeding portion and said radiating element, the method comprising:

feeding a radio frequency signal to said radiating element, and operating a switch coupled between a second position on said radiating element and said ground plane to alter the effective operating frequency band of said antenna, wherein said switch is open to radio frequency signals in a first mode and closed to radio frequency signals in a second mode, and wherein there is a substantial radiating end of the radiating element on a side of the second position which is opposite the first position, allowing the antenna device to act as a planar inverted F antenna regardless of the state of said switch.

18. The method in claim 17, wherein said switch is set into said first mode by providing a first DC-voltage on said radiating element and into said second mode by providing a second DC-voltage on said radiating element.

19. The method of claim 17, wherein said radiating element is simultaneously operable in at least said first and second frequency band.

20. The method of claim 17, wherein operating the switch includes at least one of:

opening the switch such that the antenna is simultaneously operable in a first frequency band and a second frequency band; or closing the switch such that the antenna is simultaneously operable in a third frequency band and a fourth frequency band.

* * * * *